United States Patent [19]

Cartier et al.

[11] Patent Number: 4,495,960

[45] Date of Patent: Jan. 29, 1985

[54] SUDS RETURN VALVE FOR AUTOMATIC WASHERS

[75] Inventors: Roger J. Cartier, St. Joseph Township, Berrien County; Victor W. Cuthbert; Anthony Mason, both of Lincoln Township, Berrien County, all of Mich.

[73] Assignee: Whirlpool Corporation, Benton Harbor, Mich.

[21] Appl. No.: 423,175

[22] Filed: Sep. 24, 1982

[51] Int. Cl.[3] ..... F16K 31/18

[52] U.S. Cl. ..... 137/122; 137/218; 137/390; 137/410; 137/446; 68/DIG. 2; 74/2

[58] Field of Search ..... 137/122, 625.44, 216, 137/218, 390, 429, 410, 421, 446, 448, 875; 251/74, 228, 252, 297; 74/2; 68/DIG. 2

[56] References Cited

U.S. PATENT DOCUMENTS

| | | | |
|---|---|---|---|
| 943,838 | 12/1909 | Miller | 251/297 X |
| 1,661,445 | 10/1926 | Payne | 137/410 |
| 2,244,986 | 6/1941 | Drane | 137/122 |
| 2,288,231 | 6/1942 | Drane | 137/122 |
| 2,384,628 | 9/1945 | Krone et al. | 251/74 X |
| 2,680,448 | 6/1954 | Strathearn et al. | 137/218 |
| 2,721,574 | 9/1955 | Parker | 137/122 |
| 2,786,483 | 3/1957 | Warhus | 137/122 |
| 2,788,014 | 4/1957 | Montgomery et al. | 137/122 |
| 2,877,788 | 3/1959 | Clark | 137/122 |
| 3,174,324 | 3/1965 | Ostertag | 251/74 X |
| 3,382,686 | 5/1968 | Hartley | 68/23 |
| 3,592,214 | 7/1971 | Woehler | 137/875 X |
| 3,929,149 | 12/1975 | Phillips | 137/216 |

*Primary Examiner*—Martin P. Schwadron
*Assistant Examiner*—Stephen M. Hepperle
*Attorney, Agent, or Firm*—Hill, Van Santen, Steadman & Simpson

[57] ABSTRACT

A suds return valve for automatic washers is provided in which a flapper valve can be manually set to save suds water for subsequent use, the valve being automatically returned to direct rinse liquid to drain after the suds water has reached a predetermined height in a storage receptacle. The valve can be manually set to use suds water in a wash cycle and the valve would be automatically returned to send water to the drain after a predetermined amount of suds water has been removed from the storage receptacle.

12 Claims, 8 Drawing Figures

FIG. 1
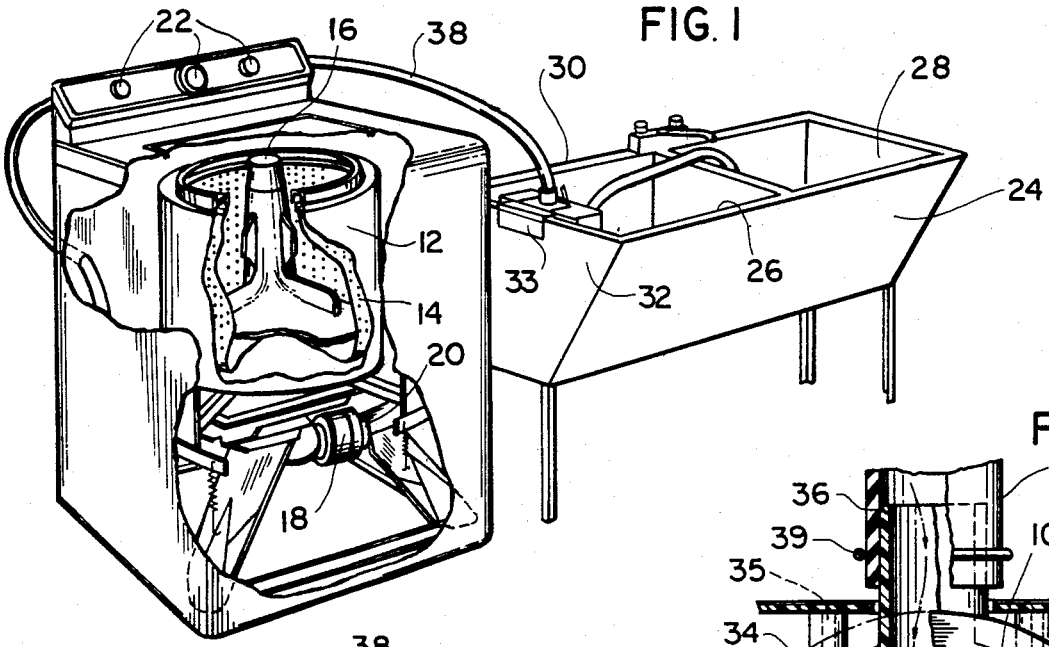
FIG. 3
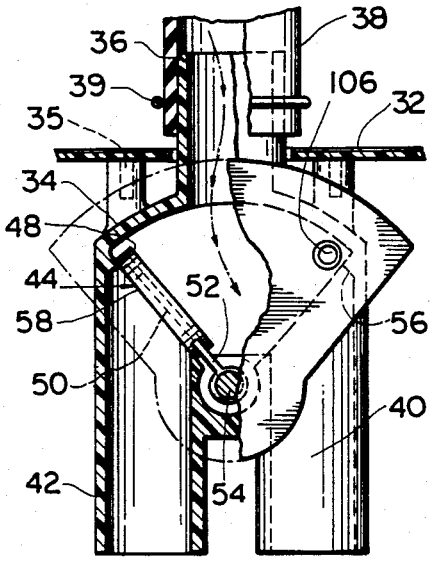
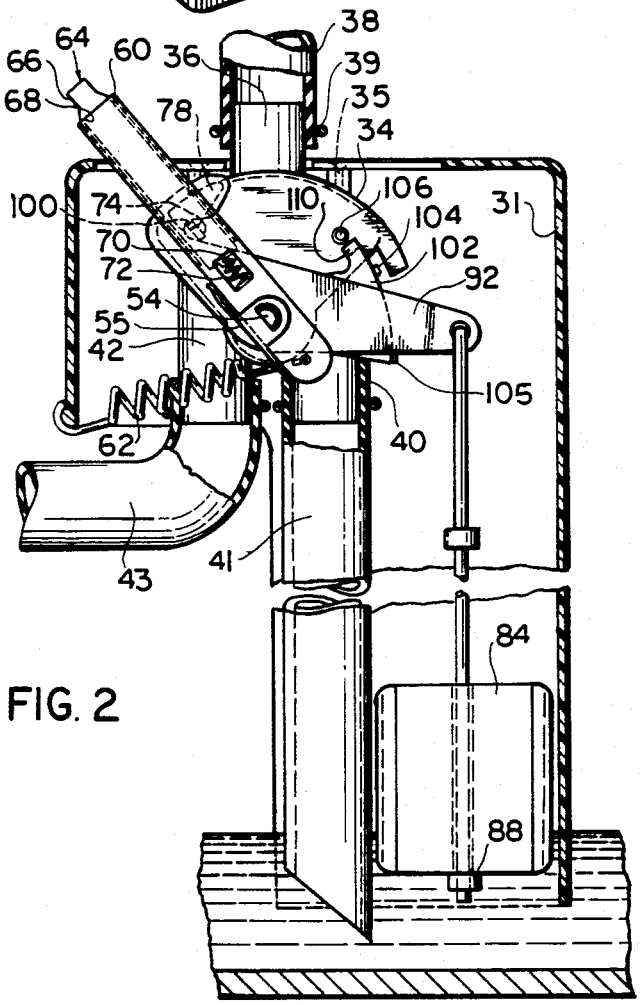
FIG. 2
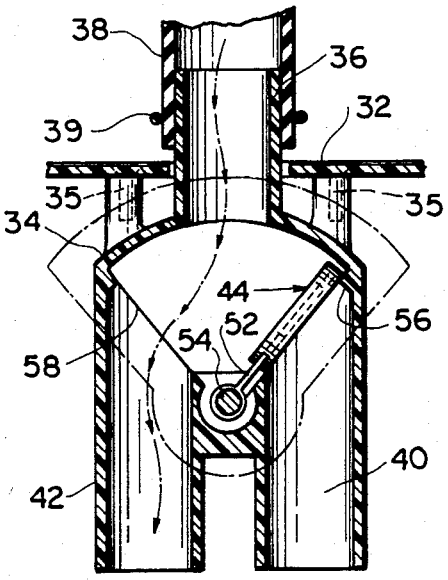
FIG. 7

FIG. 4
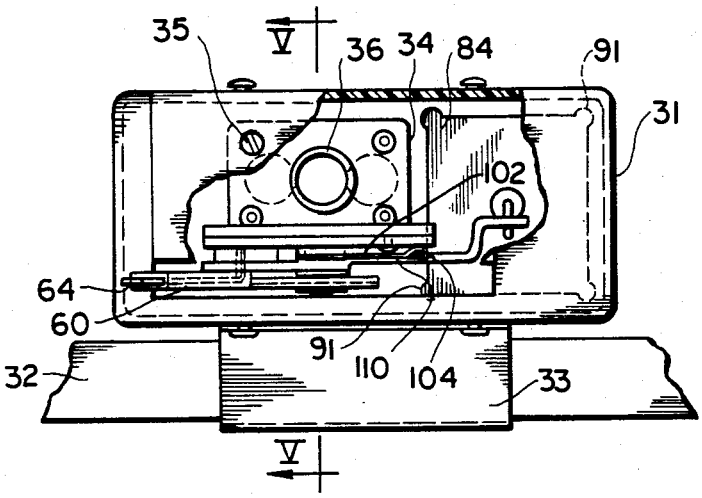
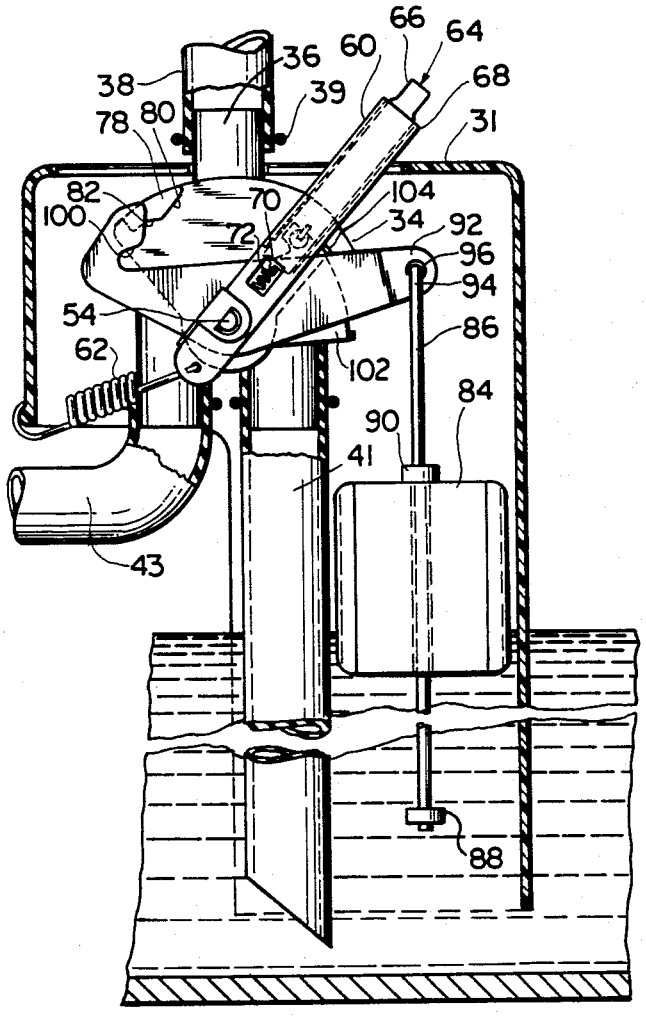
FIG. 6
FIG. 5
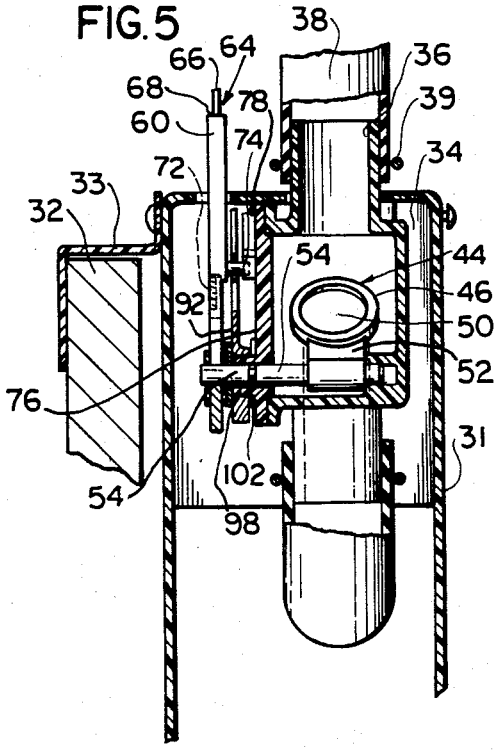
FIG. 8
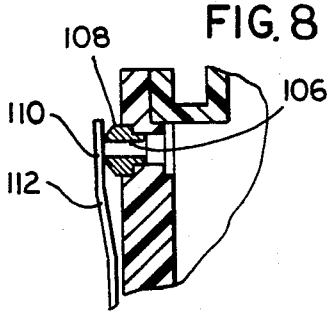

SUDS RETURN VALVE FOR AUTOMATIC WASHERS

BACKGROUND OF THE INVENTION

1. Field of the Invention

This invention relates to a means for saving wash water and more specifically to the semi-automatic saving of wash water in connection with the use of an automatic clothes washer.

2. Description of the Prior Art

U.S. Pat. No. 3,382,686 utilizes a transmission trigger pressure operated lever which positions a bi-directional valve to send the wash liquid to drain after a laundry tub has been filled to allow reuse of the laundry liquid when the pump is reversed.

U.S. Pat. Nos. 2,721,574; 2,788,014 and 2,877,788 disclose suds saving devices which utilize a float operated diverter valve for directing the wash liquid to drain when the wash tub is filled.

U.S. Pat. No. 3,425,437 discloses a pressure operated lever which positions a bi-directional valve to send the wash liquid to drain after the end of a transfer of suds water through the valve.

SUMMARY OF THE INVENTION

The present invention provides a means of semi-automatically saving the wash liquid in an automatic washer. The system utilizes a float operated valve mounted in a wash tub connected to a reversible pump in the automatic washer to allow the user to select saving the wash liquid in the wash tub to be reused in a later cycle. The valve is a non-electric module which can be fitted to any automatic washer with means to pump back saved liquid through its own drain hose. The valve can be manually set to direct wash liquid to the wash tub and automatically direct subsequent wash liquid to a disposal drain. The valve may then be manually set such that the pump in the automatic washer can return the stored wash liquid back to the machine at the beginning of a subsequent wash cycle.

BRIEF DESCRIPTION OF THE DRAWINGS

FIG. 1 is a perspective view of a washer and wash tub with the washer partially cut away to show the interior thereof including a drain pump.

FIG. 2 is a cross-sectional view of the suds return valve mechanism in the suds saving position.

FIG. 3 is a partial sectional view showing detail of the flapper valve in the suds saving position.

FIG. 4 is a partial top view of the suds return valve mechanism partially cut away to show the interior thereof.

FIG. 5 is a side sectional view of the suds return valve mechanism taken generally along the lines V—V of FIG. 4.

FIG. 6 is a side sectional view of the suds return valve mechanism in the suds return position.

FIG. 7 is a partial sectional view of the suds return valve similar to FIG. 3 but showing the flapper valve in the drain position.

FIG. 8 is a partial sectional view of a portion of the suds return valve mechanism showing the siphon break opening.

DESCRIPTION OF THE PREFERRED EMBODIMENTS

In FIG. 1 a washing machine is generally shown at 10 as having an imperforate tub 12 with a perforate basket 14 and a vertical agitator 16 therein, a water supply (not shown), an electrically driven motor 18 which is operably connected to a pump 20, and controls 22 including a presettable sequential control means for use in selectively operating the washing machine 10 through a programmed sequence of washing, rinsing and drying steps. There is also shown a wash tub 24 having a first liquid retaining receptacle or holding tank 26 and a second liquid retaining receptacle 28 connected to a drain and further having a suds return valve mechanism 30 secured to the tub 24 within the first liquid retaining receptacle 26.

The suds return valve mechanism 30 is shown ih greater detail in FIGS. 2–7. The mechanism consists of an exterior housing 31 which is attached to a wall 32 of the wash tub 24 by means of a bracket 33 as seen in FIGS. 1, 4 and 5 such that a portion of the housing 31 extends down into the retaining receptacle 26. Within the housing 31 a valve body 34 is secured by appropriate fastening means 35 such as screws. The valve body 34 has an inlet tube 36 which receives wash water from a drain hose 38 connected to the pump 20 from the automatic washer 10 as seen in FIG. 1. The pump is of the reversible type, and thus when rotated in a first direction during the agitation portion or washing step provides a suction in hose 38, and when rotated in a second direction during a drain portion of the cycle pumps washing liquid from the tub 12 through the drain hose 38. The drain hose 38 is connected to the inlet tube 36 by means of a circular wire clamp 39. The valve body 34 has two outlet tubes, a first outlet tube 40 which has connected thereto a hose 41 directed to the first liquid retaining receptacle 26 of the wash tub 24 for storing wash liquid, and a second outlet tube 42 which has connected thereto a hose 43 for directing wash liquid to the second retaining receptacle 28 for disposal to the drain or a sewer.

As seen in FIGS. 3 and 7, within the body 34 there is provided a flapper valve 44 which can alternatively close either outlet tube 40 or 42. The flapper valve 44 consists of a circular member 46, as also seen in FIG. 5, which has an enlarged annular rim 48 with a thinner central web 50. The circular member 44 is attached by means of an arm 52 to a flapper valve pivot pin 54 for rotation therewith.

The circular member 46 of the flapper valve 44 is sized to seal an opening 56 in the first outlet 40 when in the "drain" position shown in FIG. 7 and to seal an opening 58 in the second outlet 42 when in the "save suds" position shown in FIG. 3. Thus, by pivotal action of the flapper valve 44 on the pivot pin 54, the flow path of wash liquid through the valve body from the inlet 36 can either be directed to outlet 40 as shown in FIG. 3 or to outlet 42 as shown in FIG. 7.

A hollow lever arm 60 is attached to the flapper valve pivot pin 54 by a clip 55 for rotation therewith and is biased by a spring 62 as shown in FIGS. 2 and 6 in a clockwise direction toward the normal or drain position of the valve 44 closing opening 56. The lever 60 may be manually moved to the suds saving position as shown in FIG. 2 thereby causing the valve 44 to close opening 58.

A latch system is provided to retain the lever arm 60 in the suds saving position which is comprised of a slider element 64 which has a first end 66 exposed beyond a top opening 68 of the lever arm 60. A second end 70 of the slider element 64 is connected to a biasing spring 72 which normally exerts an upward force on the slider element 64 to retain it in the protruded position shown.

As best seen in FIG. 5, the slider element 64 also has a protruding tab 74 that extends toward the valve body 34. A front face 76 of the valve body 34 is provided with a protrusion 78 best seen in FIGS. 5 and 6, which has a cam face 80 and a detent 82 which coact with the tab 74 of the slider element 64 when the lever arm 60 is rotated to the suds saving position. In this position the tab 74 contacts the cam face 80 thereby causing compression of the spring 72. The tab is advanced along the cam face 80 by rotation of the lever arm 60 until the tab is urged into the area of the detent 82 where it is retained by the force of the springs 72 against the clockwise rotational force of spring 62.

Thus, the lever arm 60 is latched in the counterclockwise or suds saving position. It can be manually unlatched from this position by manually depressing the exposed end 66 of the slider element 64 thereby releasing tab 74 from the detent 82 or it can be released automatically as will now be described.

The automatic unlatching mechanism is comprised of a float 84 which is captured on a guide rod 86 between a lower stop 88 and an upper stop 90. As seen in FIG. 4, the float is generally rectangular, but also has rounded corner protrusions 91 which assist in guiding the float within the housing 31 while providing only a small surface area which would cause frictional contact between the float 84 and the housing 31. As wash liquid accumulates in the holding tank 26, the float 84 is forced to rise on the guide rod 86 until it meets the upper stop 90. After abutting against the stop 90, the float 84 will continue to rise and will operate a sector cam 92 (FIGS. 2 and 6). The sector cam 92 is pivotally connected to the guide rod 86 by means of an upper cylindrical end 94 of the guide rod 86 passing through an opening 96 in the sector cam.

The sector cam 92, as shown in FIG. 5, is pivotally connected to the valve body 34 by means of a cylindrical boss 98 extending outwardly from the face 76 of the valve body 34 concentric with the flapper valve pivot pin 54. The sector cam 92 has a cam face 100 which is in contact with the tab 74 when the lever arm 60 is in the suds saving position shown in FIG. 2 and the float 84 is below a full level. As the float rises against upper stop 90 it rotates sector cam 92 which causes cam face 100 to cam the slider tab 74 away from the detent 82 allowing the lever arm 60 under the bias of the spring 62 to flip from its position closing outlet opening 58 back to the normal drain position closing outlet opening 56 (FIG. 6).

As the sector cam 92 rotates about the axis of pivot pin 54 in the counterclockwise direction, it picks up a second sector cam 102 as it moves against a tab 104 formed on the second sector cam 102. The movement of the second sector cam 102 in the counterclockwise direction closes off a bleed hole 106 in the valve body 34. The bleed hole 106 prevents any liquid from being drawn into hose 38 during the agitation portion of the cycle even though a suction is created by the pump in hose 38. As seen in FIG. 8, the bleed hole 106 has a raised circumferential rim or boss 108 and the second sector cam member 102 has a protruding finger portion 110 which is urged against the raised rim 108 to effectively seal the bleed hole 106. The finger 110 has an offset 112 which provides it with some resiliency to further ensure a proper seal of the bleed hole 106.

Upon the return of the flapper valve 44 to its normal drain position covering outlet opening 56, the subsequent liquid pumped through the drain hose 38 from the washer 10 will bypass the holding tank 26 and flow out opening 58 through exit pipe 42 to the disposal drain or sewer. Thus, any subsequent rinses or spray rinses of the automatic washer will be pumped to drain and not be added to the holding tank.

When it is desired in a subsequent wash cycle to reutilize the wash liquid, the lever 60 is manually moved counterclockwise to its latched position shown in FIG. 2 closing off outlet opening 58. The machine is then operated without adding any fresh liquid in a dry agitate mode. This causes the pump 20 in the machine 10 to draw the wash liquid from the holding tank 26 through the pipe 40 and opening 56 upwardly through the valve body and through inlet 36 back into the machine tub 12. The bleed hole 106 is covered and thus the wash liquid can be drawn through the valve.

As the water level in the holding tank decreases, the float 84 moves down along guide rod 86 acting against lower stop 88 to rotate the sector cam 92 clockwise again unlatching the slider tab 74 and allowing the lever 60 and the flapper valve 44 to return under the bias of spring 64 to the normal drain position covering outlet opening 56. At the same time, the sector 92 abuts a tab 105 on sector cam 102 thereby rotating sector cam 102 to uncover the bleed hole 106. The open bleed hole 106 vents the interior of the valve body 34 thereby preventing siphoning of any suds if the flapper valve 44 fails to return to the normal position covering outlet opening 56 and thus failing to vent the system to the atmosphere through the sewer outlet opening 58.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. For use with an automatic washing machine operable through a sequence of washing operations in a wash cycle and a wash tub having a liquid storage receptacle and a drain, a suds return valve for returning wash liquid removed from said machine in a latter wash cycle, said suds return valve comprising:

a housing having a valve body, said valve body having a single inlet in liquid communication with said machine for receiving and returning washing liquid and two outlets, a first of said outlets communicating with said storage receptacle, a second of said outlets communicating with said drain, a flapper valve means in said valve body operative to alternatively close said first outlet in first position and said second outlet in a second position, means to normally hold said flapper valve in said first position, means to manually position and retain said flapper valve in said second position, float means vertically movable in response to the level of liquid in said storage receptacle and pivotally connected to a rotatable sector cam said sector cam rotated by the vertical movement of said float means and having means for automatically releasing said flapper valve retaining means fo return said flapper valve to said first position during said wash cycle upon a sufficient rotation of said sector cam, and means for manually releasing said flapper valve to return to said first position, whereby wash liquid passing through said valve body passes through either said first outlet or said second outlet depending on the position of said flapper valve.

2. The suds return valve of claim 1 including a vent in said valve body, said vent when open preventing the return of wash liquid from said receptacle to said machine through said inlet, and means engagable by said sector cam float means for closing said vent when said flapper valve is released to said first position.

3. The suds return valve of claim 1 wherein said means to manually position said flapper valve in said second position comprises a lever arm secured to corotate with said flapper valve which is readily accessible for manual operation.

4. The suds return valve of claim 3 wherein said means to retain said flapper valve in said second position comprises a spring loaded tab on said lever arm which is capturable in a detent in said valve body.

5. For use with an automatic washing machine operable through a sequence of washing operations in a wash cycle and a wash tub having a liquid storage receptacle and a drain, a suds return valve for returning wash liquid removed from said machine in a later wash cycle, said suds return valve comprising:

a housing having a valve body, said valve body having a single inlet in liquid communication with said machine for receiving and returning wash liquid and two outlets, a first of said outlets communicating with said drain, a flapper valve means in said valve body operative to alternatively close said first outlet in a first position and said second outlet in a second position, means to normally hold said flapper valve in said first position, means to manually position and retain said flapper valve in said second position comprising a lever arm secured to corotate with said flapper valve which is readily accessible for manual operation and a spring loaded tab on said lever arm which is capturable in a detent in said valve body, cam and float means for automatically releasing said flapper valve to return to said first position during said wash cycle, said cam and float comprising float means pivotally connected to a sector cam which operates in response to the level of wash liquid in said storage receptacle to cam said tab out of said detent, and means for manually releasing said flapper valve to return to said first position, whereby wash liquid passing through said valve body passes through either said first outlet or said second outlet depending on the position of said flapper valve.

6. The suds return valve of claim 4 wherein said means for manually releasing said flapper valve comprises manual means to compress the spring loading said tab thereby moving said tab out of said detent.

7. A valve mechanism for diverting liquid flow comprising:

a housing having an inlet and a first and second outlet, said fitst outlet directed to a liquid storage receptacle, a flapper valve in said housing operable to alternatively block said first and second outlet, said flapper valve biased to normally block said first outlet, means for manually positioning and retaining said flapper valve to block said second outlet, automatic float means responsive to liquid level in said storage receptacle and pivotally connected to a rotatable sector cam, said sector cam rotated by movement of said float means and having means for automatically releasing said flapper valve retaining means to return said flapper valve to block said first outlet, and manual means to return said flapper valve to block said first outlet.

8. The valve mechanism of claim 7 wherein said automatic float means is responsive to a maximum liquid level and a minimum liquid level to pivot said sector cam to return said flapper valve to block said first outlet.

9. The valve mechanism of claim 7 wherein said manual means can be operated at any time to return said flapper valve to block said first outlet.

10. The suds return valve of claim 2 including means automatically opening said vent upon completion of the return of said wash liquid.

11. The device of claim 7 wherein said sector cam has a cam face operable in either pivotal direction to act upon said manual positioning means to return said flapper valve to block said first outlet.

12. The device of claim 4 wherein said sector cam has a cam face engagable in either pivotable direction with said spring loaded tab to move said tab out of said detent thereby releasing said flapper valve.

* * * * *